US005529309A

United States Patent [19]

Bartlett

[11] Patent Number: 5,529,309

[45] Date of Patent: Jun. 25, 1996

[54] CARD GAME

[76] Inventor: Lawrence E. Bartlett, 39 W. Palm Dr., Arcadia, Calif. 91007

[21] Appl. No.: 439,090

[22] Filed: May 10, 1995

[51] Int. Cl.[6] ..... A63F 1/00

[52] U.S. Cl. ..... 273/292

[58] Field of Search ..... 273/292, 274, 273/309

[56] References Cited

U.S. PATENT DOCUMENTS

| | | | |
|---|---|---|---|
| 5,013,049 | 5/1991 | Tomaszewski | 273/292 |
| 5,072,946 | 12/1991 | Miller | 273/292 |
| 5,098,107 | 3/1992 | Boylan | 273/292 |
| 5,141,234 | 8/1992 | Boylan et al. | 273/306 |
| 5,224,706 | 7/1993 | Bridgeman | 273/85 |
| 5,257,810 | 11/1993 | Schorr et al. | 273/292 |
| 5,265,882 | 11/1993 | Malek | 273/292 |
| 5,288,082 | 2/1994 | Marquez | 273/292 |
| 5,314,193 | 5/1994 | Ferrer | 273/292 |
| 5,320,356 | 6/1994 | Cauda | 273/292 |
| 5,322,295 | 6/1994 | Cabot | 273/292 |
| 5,328,189 | 7/1994 | Malek | 273/292 |
| 5,366,228 | 11/1994 | Kangsanaraks | 273/292 |
| 5,395,119 | 3/1995 | Jacob et al. | 273/274 |
| 5,397,128 | 3/1995 | Hesse et al. | 273/292 |

OTHER PUBLICATIONS

Scarne's Encyclopedia of Games by John Scarne, Harper & Row Publishers, 1973, pp. 290–302.

"9's Up", Harrah's Gaming Guide How To Play, 1988.

"Baccarat Gaming Guide", copyrighted 1991 by Harrah's Casino Hotels, a Promus Company.

*Primary Examiner*—Benjamin H. Layno

*Attorney, Agent, or Firm*—Denton L. Anderson; Sheldon & Mak, Inc.

[57] ABSTRACT

A method for playing a card game is set forth wherein a dealer deals an initial hand of two cards to himself and each of a plurality of players. Depending upon the count of his initial hand, the dealer draws a third card, stands or exposes his hand; the third card altering the dealer's count. Then each player in succession opts to stand or take a third card, however drawing a third card is precluded where the dealer's initial hand has a count of 8 or 9 or, if drawn, the dealer's third card is a 9. Upon completion of the dealer's and players' play, each player's hand is resolved against the dealer's to determine wins, losses and ties. The game also provides for player side bets for non-zero ties.

11 Claims, 1 Drawing Sheet

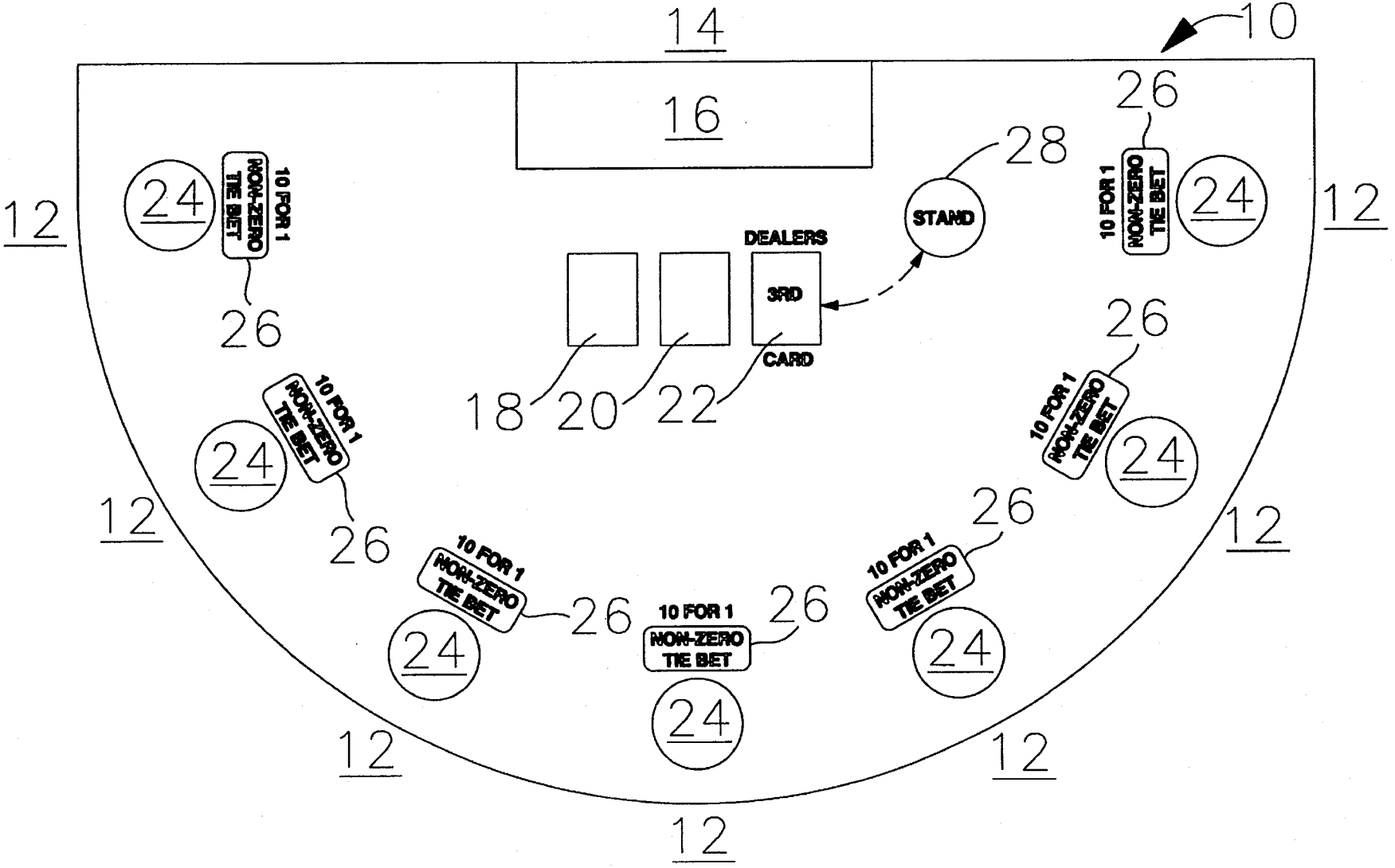
10
12
14
16
18
20
22
24
26
28
STAND
DEALERS
3RD
CARD
10 FOR 1
NON-ZERO
TIE BET

CARD GAME

FIELD OF THE INVENTION

The present invention relates to methods for playing card games.

BACKGROUND

Card games of chance are popular entertainment. In casinos throughout the world, multiple-player card games are played. For example, blackjack is popular based, in part, due to the house, or casino, paying the winning wagers, i.e., booking the bet; also because of the degree of chance and skill involved. Players in all but automatic winning hands referred to as blackjacks, must exercise choices in selecting the various options such as standing on the hand, taking additional cards, splitting the hand, doubling down, or in some cases surrendering the hand. The exercise of choice is believed to be an important component contributing to the excitement and popularity of blackjack.

Another somewhat popular card game of chance is baccarat. In baccarat there are two surrogate players who oppose each other, the Player and the Banker. The casino or house takes the opposite position of each wager. With up to 12 playing positions at a table, a bettor may place his or her wager in one of two manners: with the Banker or with the Player. The Player's objective is to get a hand that is closer to 9 than the Banker's.

After the placing of wagers with the Banker or Player, two initial cards are dealt to each of the surrogates, Player and Banker. The game is played modulo ten, that is, if the total value sum of a hand exceeds 10, then 10 is subtracted from the total, i.e., only the last digit is used as the value of the hand. Hands will always have a value of between 0 through 9. Aces have a value of 1, 10's and face cards a value of 0, all other cards have their face count.

If the Player's (or Banker's) initial two card values have a sum or count of 8 or 9, he turns his cards over immediately. The other must do likewise and the hands are resolved. A 9 wins over any lesser total. If neither the Player nor Banker has a 9, then 8 wins over any lesser total. Ties are stand-off's, i.e. pushes.

If neither the Banker nor Player initial cards have a count of 8 or 9 (requiring immediate exposure of the hands), then the Player has the next play and must stand or draw a third card according to the following table:

PLAYER RULES

| Initial Count (Sum of Values of Initial Cards) | Action |
|---|---|
| 0–5 | Draws a card |
| 6–7 | Stands |

The value of the third card if drawn is added to the values of the initial two cards, modulo ten, to arrive at the Player's final hand count. If no third card is drawn, the initial count becomes the Player's final count.

Then it is the Banker's turn. The Banker's action is determined by: (1) his initial 2-card hand count and (2) the value of the third card, if any, drawn by the Player. The Banker's action follows these rules.

| Initial Count (Sum of Values of Initial Cards) | Draws if Value of Third Card Dealt to Player | Does Not Draw if Value of Third Card Dealt to Player Is |
|---|---|---|
| 3 | 0–7, 9, or no card | 8 |
| 4 | 2–7, or no card | 0, 1, 8–9 |
| 5 | 4–7, or no card | 0–3, 8–9 |
| 6 | 6–7 | 0–5, 8–9, or no card |
| 7 | stands | stands |
| 8–9 | turns over | turns over |
| 0–2 | draws a card | draws a card |

The foregoing rules are based on the odds of bettering the Banker's initial hand count relative to the player's possible total. They are fixed rules. If a third card is drawn, its value is added to the values of the initial cards, modulo ten, to arrive at the Banker's final count. If no third card is drawn, the Banker's initial count becomes the Banker's final count.

Once play is completed by the Banker, the final hands are turned over and resolved with the hand with the final count closest to 9 deemed the winner. Wagers are then paid even money to all those who wagered with the victorious Banker or Player. Wagers with the loser are collected. Ties are a push and no one wins or loses. Since the odds favor the Banker, a 5% commission is collected by the casino on winning bets placed with the Banker.

In baccarat, there are no choices. When cards are drawn or when the Player or Banker stands are determined by the tables set forth above. Further, all those wagering with the Player (or Banker) are bound by the play and luck of their surrogate.

Chemin de Fer differs from baccarat in that players occupy both positions of Banker and Player with the house taxing the winnings of the player acting as Banker. The Banker position rotates, or can be usurped with the "Banco" wager.

Continental baccarat (played in France) gives the Player an option of drawing or standing only on an initial count of 5. The Banker's draw is entirely optional.

Baccarat and chemin de fer, due to their rules of play, have not enjoyed any major success as a casino table card game in the U.S. There is generally only one table experiencing action, and that is only because it is in a lavish setting, appealing to a very small percentage of potential players. Attempts at introducing "mini-baccarat" on a table the size of a blackjack table have had only a token response. The deficiencies noted above of complex, strict rules regarding the drawing of a third card, limited player participation and choice and the taking back of a commission from some of the winnings simply cannot compete with the excitement derived from the degree of choice and skill in betting and selecting a card offered in games such as blackjack or poker. There is a need for a casino card game different from and competing with blackjack to provide players with variety and appeal to a broad spectrum of customers.

SUMMARY OF THE INVENTION

Toward this end, I have invented a new method for playing a card game which overcomes the deficiencies noted above and provides a game of great excitement. The game permits each of multiple players to play their own hands against the dealer and provides them with options in an effort to assemble a hand of final count sufficient to beat that of the dealer. Furthermore, there is no commission assessed against any player in that the casino or house acts as the banker paying even money on winning bets and collecting losing bets. Still further, the method which I invented for playing the casino card game results in a house advantage which I have calculated to be approximately 0.8% (where the player plays the best possible game) providing the casino or house with their advantage needed to make hosting the game profitable. As but yet a further novelty, the card game according to my invention has the dealer going first to assemble his/her hand providing the perception of an advantage to the players. Unlike blackjack the players do not "bust out" in advance and then have to wait until the next round. All hands must ultimately be resolved against the dealer's. As a further embodiment, my method of playing the card game includes a side bet to further enhance the players' choices and excitement in the game and, if those players opt to make this wager, provides an additional percentage advantage to the house.

Accordingly, there is set forth according to the present invention a card game to be played by one or more players and a dealer using at least one deck of playing cards. Multiple decks may be used as well. Each player makes a wager of his or her choosing and in their own behalf. The dealer deals two cards to each player and to the dealer, at least the dealer's cards being dealt face down. The dealer then assesses, out of the view of the players, the initial count of the dealer's hand. The initial count is determined by adding the value of the two cards subject to the rules that an ace has a value of 1, 10 through King are valued as 0 and all other cards have their face value (e.g. a 7 has a value of 7). The card values, subject to the preceding rules, are summed modulo ten, that is for sums of 10 or greater only the last digit is used, i.e., a value sum of 14 is counted as a 4. The dealer then draws a card if his initial count (i.e. the sum modulo ten of the values of the initial cards) is 0 through 4, exposing only the drawn third card to the players. The dealer stands on his initial hand if the count is 5 through 7, and the dealer exposes his hand to the players if the count is 8 or 9. If a third card is drawn, it is added to the first two cards, modulo ten, to determine the dealer's final count. Otherwise, the dealer's final count is equal to his initial count.

Subsequent to the dealer's play, the players in succession each assess the count of their own initial hands according to the same rules applied to the dealer and opt to be dealt a third card or stand on that initial count. Each player is precluded from being dealt a third card when the dealer's initial count is 8 or 9 (where the dealer exposes his hand) or, if drawn, the dealer's third card is a 9. In those events play is stopped, the hands are exposed and resolved as described below.

Like the dealer, if a third card is opted to be drawn by a player, its value is added to the value of the initial two cards, modulo ten, to arrive at the player's final count. If no third card is drawn the initial count becomes the player's final count.

After all the players have completed their play, the hands are resolved as between each player and the dealer. The dealer's final count is the sum of all dealer's cards subject to the rules described above, i.e., if the value is 10 or greater only the last digit is used. The players' final counts are each determined in a like manner. If the player's final count exceeds that of the dealer, i.e. is closer to 9 than the dealer's, the player wins and is paid even money on his or her wager. If the dealer's final count is greater than the player's final count, i.e. is closer to 9 than the player's, the dealer wins and the player's wager is collected. If the dealer's final count is the same as the player's final count, the player does not win nor lose, i.e., it is a push, and the wager is neither paid nor collected. Play then continues with the dealing of a subsequent hand, with new wagers placed.

As a further embodiment, each player can opt to place a side wager bet that the final count of the dealer's hand and player's hand will be a non-zero tie. For example, the final count of the dealer's hand and the player's hand tie at 4. Should such a non-zero tie result, this wager can be paid off at greater than even money and up to odds of 10 for 1, i.e., 9:1. Should the hands not tie, the wager is collected. If the player's hand and dealer's hand are a zero tie, it is a push and the wager is neither paid nor collected.

The game provides for a high degree of excitement, is simple and fast moving. The Dealer is not burdened with making change for commissions. Each of the multiple players are not bound to succeed or fail with the selected surrogate Player as in baccarat or chemin de fer in that each places a wager of an optional amount and plays their own hand. Each player can make, subject to the rules of the game, his or her own choices as to taking an additional card to try to improve his final count. Further, by the dealer going first under the rules of this game, players perceive an advantage in that the dealer's actions show part of the dealer's hand or produce strong clues as to what the dealer's final count could be. This perceived advantage enhances the excitement of the game. Also, regardless of the player's action he does not "bust out" of the hand early. In blackjack the player (going first) can draw cards to result in a hand value of 22 or greater resulting in a bust. In this case the player loses immediately, the player's wager is collected and the player then has to wait for the next hand. According to my game each player is in the game until the hands are finally resolved. Still further, the side, non-zero tie bet, further increases the excitement of the game by enabling the players who like enhanced odds to strive for a high payoff.

BRIEF DESCRIPTION OF THE DRAWINGS

These and other features and advantages will become appreciated as the same becomes better understood with reference to the specification claims and drawing which illustrates a layout for the card game according to the present invention.

DESCRIPTION

With reference to the drawing, a basic layout 10 for playing the game according to my present invention is illustrated. Of course it is to be understood that many other layouts could be adopted to accomplish the same ends.

The layout 10 may be fashioned on a felt table and is configured to have a plurality of player positions shown as player positions 12 around the layout 10. A dealer's position 14 is also provided in view of the players. A tray 16 is provided proximate to the dealers position 14 to accommodate the wagering tokens, i.e. chips, paid and received during the play of the game. Also in front of the dealer may be indicated areas or spots 18, 20, 22 for the dealer to position his or her cards as dealt during the play of the game. Spots 18 and 20 may be combined as a single spot or area if desired. Furthermore, if desired, spot 22 may have indicia informing the players that this is the position for the dealer's third card. For example, the layout 10 at spot 22 may have written therein "Dealer's 3rd Card" or similar indicia.

Associated with each player 12 is a wagering area 24 which may be marked by a circle, logo or other graphic sufficient to enable the player and dealer to associate a wager made by the player in that area with the specific player. For purposes of illustration, layout 10 has these wagering areas 24 indicated by circles.

Proximate the wagering area 24 for each player is a supplemental or side betting area 26. Side betting area 26 may be suitably identified to associate a wager in this area with the specific player. Again a circle, logo or square may be used or the area may be inscribed with the phrase "Non-Zero Tie Bet". Of course other suitable indicia may be used. With the layout 10 now described, the method for playing the card game of chance according to my invention will now be set forth.

The game is played with one or more traditional 52 card decks of playing cards. The dealer deals from the deck or decks for each succession of hands until re-shuffling is required. The casino or house chooses when to reshuffle.

Prior to dealing, each player makes a base wager in an amount determined by the player, placing that wager in the approximate wager area 24. Assuming the game is played using chips, the player would simply put a number of chips in the wagering area 24 to constitute the player wager. Table minimums or maximums may dictate to some extent the minimum or maximum base wager to be placed by the player. After each player has made the requisite base wager, the dealer deals two cards to each player and to him or herself. The dealing may take place sequentially, i.e., one card to each player and the dealer followed by a second card dealt to each player and dealer, or the cards may be dealt two cards to each player in succession. The dealer's cards are dealt face down and are placed each in spots 18 and 20. The player's hands are dealt to each player either face up or face down, for example, in the wagering areas.

Subsequent to the initial deal, the dealer has the initial play. To determine the dealer's play, the dealer must make an assessment of the initial count of his or her hand. The count is determined by the dealer, as well as the player, according to the following rules:

(1) Aces have a value of 1;

(2) 10s through Kings have a value of 0;

(3) All other cards have a value equal to their face value.

A count is determined modulo ten by simply adding the values of the cards of the dealer's initial hand. The initial hand count assessment is done outside of the view of the players. If the value sum is 0 through 9, the initial count equals the sum, however for sums of 10 through 18 the count is determined by ignoring the first digit, i.e. an initial hand of an 8 and a 9 has a value sum of 17 and a corresponding count of 7.

As can be appreciated, the count will never exceed a nine nor be less than zero. As can further be appreciated, determining the count is quite easy.

After determining the initial count, the dealer must complete his or her play. The game according to my invention has the dealer going first which, as described below, provides the player, to at least his perceived advantage, with some information as to the dealer's initial count and possible final count.

Returning the initial cards to the spots 18 and 20, if the hand has an initial count of 0 through 4, the dealer draws a third card from the deck and places it face up in spot 22 for the players to see. The third card value, as described below, will eventually be added to the initial hand value, modulo ten, to obtain a final value and corresponding final count of the dealer's hand. For example if the first two cards were a 7 and a 5 (initial value of 12 and a corresponding initial count of 2 since the first digit is ignored) and the third card is a 7, the final value is 19 having a count of 9 (first digit is ignored). This final value becomes the dealer's final count.

If the initial count of the dealer's hand is 5 through 7, the dealer stands and does not draw a third card. An indicator such as a blank card, joker, or puck 28 may in this situation be moved by the dealer to spot 22 to signify that the dealer is standing.

If the dealer's initial count is 8 or 9, the dealer does not draw a third card and turns over his cards to expose them to the players. Where the dealer stands or exposes his cards the initial count is the dealer's final count.

Where the dealer's initial count is 8 or 9 and he exposes his hand, the players, as described below, are precluded from taking a third card and all hands are immediately revealed and resolved. Further, if the dealer draws a third card and that third card is a 9, as also described below, the players are precluded from taking further action by drawing a third card and all hands are immediately revealed and resolved without further play.

After completion of the dealer's play, the players now each in succession have the opportunity, subject to the rules described below, to attempt to beat the dealer's hand. Like the dealer, each player will determine the initial count of his or her hand according to the rules described above, i.e. an ace is 1, 10 through King are 0 and for sums of 10 or more the count is the last digit (a value of 17 has a count of 7). Depending on the actions of the dealer, each player may decide to stand on their initial count or take a third card. In instances where the player can and opts to take a third card, the value of the third card is added to the value of the two initial cards, modulo ten, to determine a final count for the player's hand. By taking a third card each player is attempting to alter his initial count to have a final count exceeding that of the dealer, i.e. closer to 9 than the dealer, to defeat the dealer and win his wager. Each player, however, is precluded from taking a third card if the dealer's initial count is 8 or 9 (when the dealer exposes his cards) or if the dealer's third card drawn and exposed is a 9, e.g. a 9 of spades. In these circumstances the players must stand on their initial counts which then become their final counts, and the hands are immediately revealed and resolved without further play.

Subsequent to the completion of play by each player in succession, the dealer's hand is now resolved as against each of the player's hands. If the dealer's final count exceeds that of the player, the dealer wins and the player's wager is collected. If the player's final count exceeds that of the dealer, the player wins and his wager is paid at even money. If the dealer's final count and the player's final count are the same, that is a tie and the player neither wins nor loses his or her wager, i.e., it is a "push".

After the hands have been resolved, the cards in play are collected, wagers are made for the next round, and new hands are dealt.

With reference to the drawing, a side wager may be made by each player prior to the deal. Each player may place a side wager in the side wager area 26 denoted as "Non-Zero Tie Bet". Should the dealer's final count and the player's final count be the same and not 0, the player's side wager is paid. The non-zero tie bet may be paid at enhanced odds to entice such wagers. These wagers, in the event of a non-zero tie, may be paid at for example 10 for 1, i.e., 9:1, or less. For hands where the player's final count and the dealer's final count tie at 0, the wager is deemed a push and is neither paid nor collected. Where final counts do not tie, the wager is collected.

As a modification to my game, players may be precluded from taking the additional third card if the dealer's drawn and exposed third card is not only a 9 but an 8 as well.

I have determined that under the rules of the basic game described above, i.e., not precluding a player from drawing a third card when the dealer's third card drawn is an 8, provides an advantage to the dealer or house of approximately 0.729%. This assumes that each player is playing perfectly and accordingly, in practice, the house would realize a greater percentage of return. If the drawing by the dealer of a third card 8 precludes the players from drawing, the house advantage is increased to about 1.29%.

I have also determined that paying off the non-zero tie bets at the odds of 10 for 1 (9:1) results in a house advantage of approximately 3.98% on this side bet.

As can be appreciated, the rules of my game are simple, easy to follow, providing for rapid playing of the game. Furthermore, the players are given the choice as to the amount of the base wager, whether to make the side, non-zero tie, wager and furthermore, in all instances except where precluded by the dealer having an initial count of 8 or 9 or drawing a third card 9 (or 8 pursuant to an additional embodiment), can opt to take a third card and alter the final count of his or her hand. Additionally, having the dealer go first in completing his or her hand, introduces a novelty which is not present in the usual casino table games like blackjack. The dealer's play enables the players to determine a range for the dealer's count by the dealer's actions. That is if the dealer stands, that means the dealer's count is 5 through 7 and if the dealer draws that means the dealer's initial count is 0 through 4. Given that the dealer's drawn third card is exposed, a range of final dealer hand counts can be determined. This will give the players some information before making their choices to take a third card or stand. This in turn, it is believed, will entice players to the game and enhance the excitement.

Further, the fact that the player does not "bust out" will give the players a sense of fairness. The house or casino will appreciate the fast-moving action of the game with a minimum of shuffle time and no lost time making commission calculations as in chemin de fer. Also, the enhanced odds side bet contributes to the excitement.

While I have shown and described certain embodiments of the present invention it is to be understood that it is subject to many modifications and changes without departing from the spirit and scope of the claims set forth below.

I claim:

1. A method for playing a card game played by at least one player against a dealer with playing cards comprising:

(i) the player making a base wager;

(ii) dealing an initial player's hand of two cards to the player and an initial dealer hand of two cards to the dealer;

(iii) assessing the count of the dealer's initial hand by adding the values of the cards dealt, the 10 through King assigned a 0 value and sums of two digits having a count equal to the last digit;

(iv) completing the dealer's hand first by the dealer drawing and exposing a third card if the dealer's initial hand has an initial count of 0 to 4, standing if the count is 5 to 7 and exposing the initial hand if the count is 8 or 9;

(v) determining the dealer's final count by adding the values of all cards dealt to the dealer, the 10 through King assigned a 0 value and sums of two digits having a final count equal to the last digit of the sum;

(vi) each player ascertaining the count of their initial player's hand by adding the value of the cards dealt, the 10 through King assigned a 0 value, sums of two digits having a count equal to the last digit, and subsequent to completion of the dealer's hand, opting to stand so that the initial count becomes the final count or to be dealt a third player card the value of which is added to the values of the initial hand to determine the final count of the player's hand, each player precluded from being dealt a third card if the dealer's initial hand has a count of 8 or 9 or if the dealer's drawn and exposed third card has a value of 9; and (vii) resolving the player's hand final count in comparison to the dealer's final count, a player's hand having a final count greater than the dealer's final count resulting in a win for the player, player's final count equal to the dealer's constituting a tie and player's hand having a final count less than the dealer's final count constituting a loss, the dealer paying the player even money for a win and collecting the base wager for a loss.

2. The method of claim 1 further including placing a side wager prior to the deal by the player, the side wager paid in the event the player's and dealer's final hand counts are tied and non-zero, the side wager lost for hands that are not tied and the side wager neither paid or collected for zero ties.

3. The method of claim 2 further including paying the players' side wagers in the event of a non-zero tie at odds of 10 for 1 or less.

4. The method of claim 1 further including precluding the players from taking a third card in the event that the dealer's third card has a value of 8.

5. A method for playing a card game played by one or more players against a dealer with playing cards comprising:

(i) each player making a base wager;

(ii) each player placing if desired an optional side wager;

(iii) the dealer dealing an initial player's hand of two cards to each player and an initial dealer hand of two cards to the dealer, at least the dealer's cards dealt face down;

(iv) assessing by the dealer out of the player's view the count of the dealer's initial hand by adding the value of the cards dealt, the 10 through King assigned a 0 value and sums of two digits having a count equal to the last digit;

(v) completing the dealer's hand first by the dealer drawing and exposing a third card if the dealer's initial hand has a count of 0 to 4, standing if the count is 5 to 7 and exposing the initial hand if the count is 8 or 9;

(vi) determining the dealer's final count by adding the values of all cards dealt to the dealer, the 10 through King assigned a 0 value and sums of two digits having a final count equal to the last digit of the sum;

(vii) each player ascertaining the count of their initial player's hand by adding the value of the cards dealt, the ten through King assigned a zero value, sums of two digits having a count equal to the last digit and opting in succession and subsequent to completion of the dealer's hand to be dealt a third player card the value of which is added to the values of the initial hand to determine the count of the player's hand, each player precluded from taking a third card if the dealer's initial hand has a count of 8 or 9 or if the dealer's drawn and exposed third card has a value of 9; and (viii) resolving the player's hand count in comparison to the dealer's hand count, a player's hand having a count greater than the dealer's count resulting in a win for the player, player's count equal to the dealer's constituting a tie and player's hands having a count less than the dealer's count constituting a loss, the dealer paying the player even money for a win and taking the base wager for a loss, the side wager paid in the event of a non-zero tie and collected for a non-tie.

6. The method of claim 5 further including paying the player's side wager at odds greater than even money.

7. The method of claim 6 further including paying the player's side wager at odds of 10 for 1 or less.

8. A method for playing a game with cards by at least one player against the house comprising:

(i) the player making a base wager;

(ii) dealing an initial player's hand of two cards to the player and an initial hand of two cards to the house;

(iii) assessing the initial count of the house's hand, modulo ten;

(iv) completing the house's hand first by drawing and exposing a third card if the house hand has an initial count of 0 to 4, standing if the initial count is 5 to 7 and exposing the initial hand if the initial count is 8 or 9;

(v) the player ascertaining the count of his initial hand, modulo ten, and opting, subsequent to completion of the house's hand, to stand or to be dealt a third player card, the values of all cards dealt to the player summed, modulo ten, to determine the player's final count, the player precluded from taking the third card if the house's initial hand has a count of 8 or 9 or if the house's drawn and exposed third card has a value of 9; and (vi) resolving the player's final count in comparison to the house's final count, the house's final count determined by adding the values of all cards dealt to the house, modulo ten, a player's final count greater than the house's constituting a win for the player, the player's final count equal to the house's constituting a tie and the player's final count less than the house's final count constituting a loss, the house paying the player even money for a win and collecting the base wager for a loss.

9. The method of claim 1, further including placing a side wager bet by the player prior to the deal, the side wager paid in the event the player's and house's final hand counts are tied and non-zero, the side wager collected for final hand counts that are not tied and the side wager neither paid or collected for zero ties.

10. The method of claim 9, further including paying the player's side wager in the event of a non-zero tie at odds of 10 for 1 or less.

11. The method of claim 8, further precluding the players from taking a third card in the event that the house has drawn and exposed a third card having a value of 8.

* * * * *